United States Patent [19]

Temple

[11] Patent Number: 4,697,735

[45] Date of Patent: Oct. 6, 1987

[54] HUMIDIFYING HOT WATER HEATER

[76] Inventor: John Temple, 123 W. Second St., Chattanooga, Tenn. 37402

[21] Appl. No.: 879,488

[22] Filed: Jun. 27, 1986

[51] Int. Cl.[4] ..... F22B 1/28

[52] U.S. Cl. ..... 236/44 C; 237/78 R; 219/272

[58] Field of Search ..... 219/310, 312, 316, 319, 219/328, 331, 332, 271, 272, 273, 275, 276; 236/44 A, 44 R, 44 C; 237/78 A, 78 R

[56] References Cited

U.S. PATENT DOCUMENTS 2,084,365 6/1937 Weber ..... 237/78 A 3,092,179 6/1963 Lauck ..... 236/44 A X

*Primary Examiner*—Henry A. Bennet

*Attorney, Agent, or Firm*—Alan Ruderman

[57] ABSTRACT

A humidification system for a building utilizing a hot water heating tank within which is mounted a plenum chamber. Hot water from the tank is directed into the plenum chamber in controlled quantities and is agitated as controlled by a humidistat within the building to either vaporize the water within the plenum chamber or to force pressurized air through the plenum chamber to wet the air. The vaporized water or the wet air is directed from the plenum chamber into the air supply of the building. A water level control in the form of a float valve maintains the level of the water within the plenum chamber at a controlled level. The water may be vaporized by an electrical heater within the plenum chamber or the water may be aerated by air forced through the plenum chamber by a compressor, the humidistat activating the heater or the compressor.

14 Claims, 3 Drawing Figures

HUMIDIFYING HOT WATER HEATER

BACKGROUND OF THE INVENTION

This invention relates to the environmental control of buildings and more particularly to a humidifying system utilizing hot water heaters of such buildings.

It is notoriously well known that during the heating season as the air within a building is heated the relative humidity of the air is reduced, and moisture must be supplied to the air to maintain a reasonable comfort zone for persons within such structures. This is especially critical in warm or hot air heating systems where the air is heated and supplied to the space within the building at very high temperatures. A large proportion of the residential heating systems in use in this country today are of the forced warm-air type and unless some humidification is supplied to the air the air becomes very dry during the heating season resulting not only in discomfort but an unhealthy environment due to the drying out of the mucus membranes of the residents, thereby creating conditions whereby the common cold and influenza flourish. Moreover, the dry air results in damage to furnishings, especially wood furniture and presents conditions under which fires can readily occur.

The known residential humidification systems include those which are utilized in connection with the furnace for heating the air. The air either flows over a water source such as a rotating drum carrying a water absorbing porous belt cyclically picking up water from a pan and giving up the water to the air in the plenum of the furnace. Porous plates are also utilized in a similar manner. Other systems, used in industrial and commercial buildings, spray the water into the air ducts of the warm air system. Of course, separate free standing humidifiers are also available for residential use. In the systems installed in the furnace or the duct-work, humidistats control the amount of water supplied to the air. For example, in the rotating drum type humidifier the humidistat controls the rotation of the drum by means of the drive motor.

The humidifiers utilized in residential heating systems generally are not reliable and require excessive maintenance. This is especially true in those areas of the country where the supply water is high in mineral content. For example, in those systems utilizing porous belts or plates, the belts or plates must be cleaned of the materials which fill the pores, and must be replaced frequently.

In all known dwellings having internal plumbing there is some form of water heater for heating the incoming water for use at the tap. Cold water enters the heater tank, is heated and maintained at a temperature set by a thermostat—generally in the range of 140° F. to 150° F.—and maintained under pressure so that the water can flow when the hot water tap is opened. Presently, at least for residential use, the water heaters have no other function.

SUMMARY OF THE INVENTION

Consequently, it is primary object of the present invention to provide a hot water heater having means for humidifying the air in a building in which the heater is contained.

It is another object of the present invention to provide a water heater for supplying hot tap water and having means for selectively supplying water vapor into the environmental air of the building containing the water heater.

It is a further object of the present invention to provide a hot water tank for a building having a heated air supply, the heater having means for vaporizing a controlled amount of the heated water selectively for entering into the air supply of the building to increase the relative humidity of the air as desired.

Accordingly, the present invention provides a hot water tank having conventional water heating means and additionally means for adding additional energy to a small amount of such heated water selectively to agitate and remove controlled amounts and direct it into the air stream of a building for increasing the relative humidity of the air stream. Preferably the heated water withdrawn for humidification is vaporized by additionally heating controlled quantities thereof within a plenum chamber within the hot water tank or a pressurized aerator arrangement may be utilized wherein air is forced through a plenum holding controlled quantities of the water heated by the hot water tank. A humidistat may control the additional heat suppled or the air forced through the controlled quantities of water. A simple float type control valve or the like may control the amount of water within the plenum chamber in either construction.

Specifically, the hot water tank, in the preferred embodiment, has a plenum chamber disposed therein separated from the remainder of the hot water tank and receiving a controlled amount of heated water therefrom as determined by the control valve. The hot water within the plenum chamber is heated to vaporization as determined by the humidistat and the vapor is supplied to the air stream of the building. The remainder of the hot water tank and system is conventional. In another embodiment, pressurized air may be aerated through the controlled amount of water within the plenum chamber, the amount of pressurized air being humidistatically controlled.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
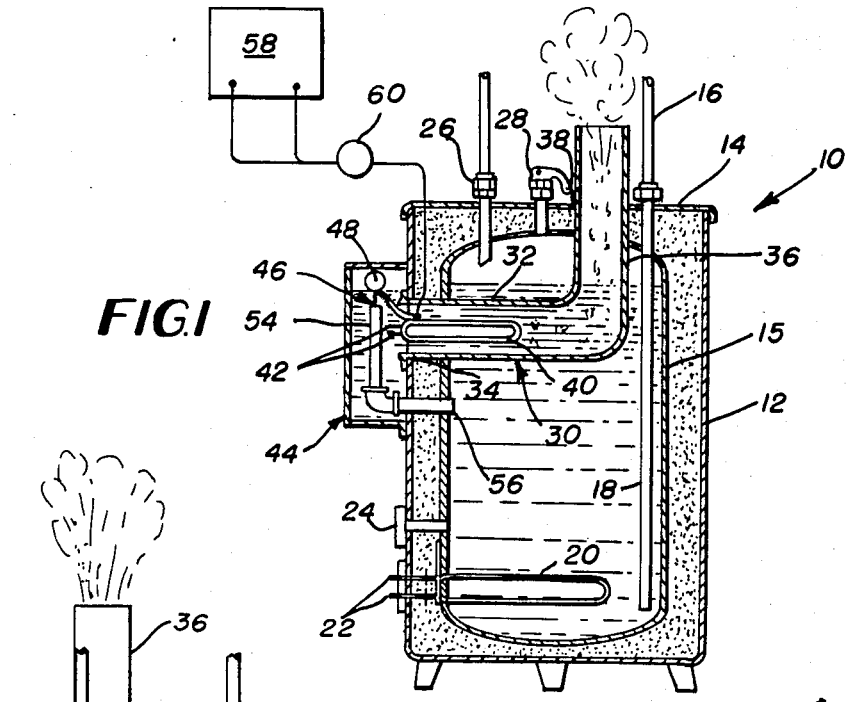
FIG. 1 is a diagrammatic cross sectional representation of a hot water heating tank having humidification apparatus constructed in accordance with the principles of a first embodiment of the present invention.
Figure 2:
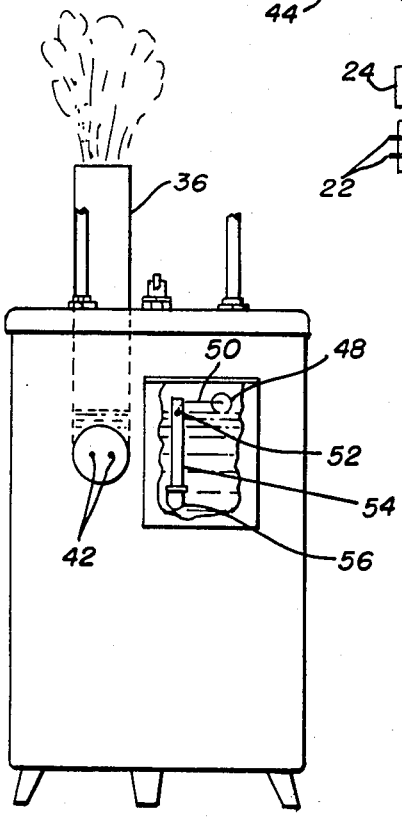
FIG. 2 is a side elevational view thereof.

Referring now to the drawings, a hot water heating tank is illustrated generally at 10 and conventionally comprises an elongated cylindrical casing 12 closed at the top 14 and bottom and separated by insulation from the water containing tank 15. A water inlet pipe 16 communicates with the interior of the tank through a tube 18 directed downwardly so that the entering cold water enters the tank adjacent the bottom thereof. The water in the tank may be heated by any of the conventional heating means, such as burning of natural gas or fuel oil or may be electrically heated. For convenience and for ease of presentation, the hot water tank 15 is illustrated as being an electrically heated unit. As illustrated, at least one electrical resistance heating coil 20 is disposed within the tank and has connecting terminals 22 extending outside and disposed on the exterior sealed from the water within the tank. Conventionally, electrical power is supplied to the terminals 22 to heat the coil, the supply of electrical energy being regulated by a thermostat 24 which controls the temperature of the water within the tank. The temperature within the water within the tank conventionally, for residential use, is maintained in the range of approximately 140° to 160° F. A hot water outlet 26 is disposed at or adjacent the upper end 14 of the tank casing for supplying the hot water needs of the building, e.g., a residential dwelling, as called for by the conventional valving and spickets within the building. As is conventional, the pressure within the tank casing is above static or atmospheric pressure, generally in the range of approximately 30 to 45 pounds per square inch, and a pressure relief valve 28 is provided for safety purposes.

In accordance with the principles of the present invention, a plenum chamber 30 of any convenient form which, as illustrated, may be a conduit bent so as to have the end of a first leg 32 extending through an aperture 34 in the wall of the tank casing, and an end portion of a second leg 36 extending angularly relative to the first leg and protruding through an aperture 38 in the top 14 of the tank casing and connected as hereinafter described to an air system substantially under static or atmospheric pressure. Disposed within the first leg 32 of the plenum chamber 30 is a heating element such as an electrical coil 40 having its terminals 42 extending through the wall of the tank casing 12 and sealed adjacent to the terminals in the walls of the tank casing. Thus, electrical energy may be supplied to the coil without leakage of water past the seal.

Removably fastened on the exterior of the wall of the tank casing is a small housing 44. Disposed within the housing 44 is a water level control 46 which preferably is a simple float valve having a floatable ball 48 on the end of a rod 50, the other end of the rod being pivotably connected to the valve stem of a simple gate valve 52 disposed within a small conduit 54 for opening and closing flow communication therewith. The conduit 54 extends downwardly toward the bottom of the housing 44 and has a bend or other small conduit 56 at its lower end extending through the wall of the tank 15 and casing 12 in sealed relationship with the tank 15 and into the central portion thereof. Thus, the hot water under pressure in the tank casing may flow up through the conduits 56 and 54 whenever the valve is opened by the operation of the ball 48 floating on the water within the housing 44 to control the level of the water within the plenum chamber 30.

A conventional humidistat 58 is disposed at a convenient location in the building for determining the relative humidity of the air therein and for controlling a relay 60 or the like for closing an electrical circuit in which the heating element 40 is a part. Whenever the relative humidity as determined by the humidistat 58 is below a preset amount, electricity flows to the coil 40 to heat the water within the plenum chamber 30. As the water within the plenum chamber 30 is heated to the vaporization point, steam is released through the leg 36 of the plenum chamber. The outer end of the leg 36 may be connected into an air duct of a warm air heating system for distribution into the various rooms of the building, or it may supply the various rooms by separate duct-work or the like.

Since the temperature of the water within the tank 15 is always maintained in the preset range of approximately 140° F. to 160° F., only a small amount of additional heat is required to raise the temperature of the water within the plenum 30 to the vaporization point, so that only a small amount of energy is required for humidification purposes. However, since steam is released into the building, the humidification process is very efficient relative to the known systems. Moreover, little, if any, maintenance is required for the system. By mounting the float valve in the housing 44 outside the water tank, it is readily accessible for servicing when necessary.

Figure 3:
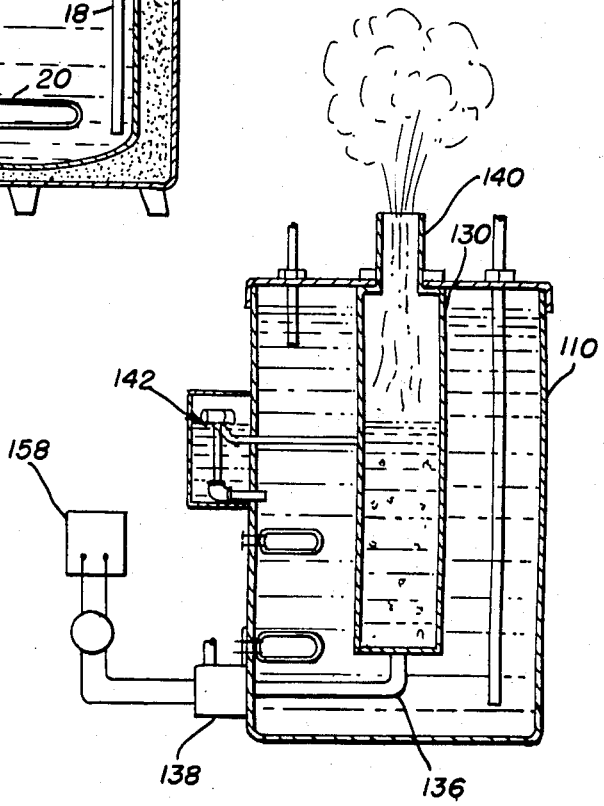
FIG. 3 is a view similar to that of FIG. 1 illustrating a second embodiment of the humidification apparatus.

In FIG. 3 a modified embodiment of the invention is disclosed wherein the hot water tank 110 has a central plenum 130 connected by a conduit 136 to an air compressor 138 on the outside of the tank. The compressor is controlled by a humidistat 158 to pump air through the plenum as required as the relative humidity drops below the desired amount. The air bubbles up through the hot water within the plenum chamber 130 and is warmed and wetted thereby. The warm humid air flows out a conduit 140 which communicates with the plenum and extends out the top of the tank. A float valve level control 142 may be utilized in a manner similar to that in the first embodiment to maintain the desired level of water within the plenum.

Numerous alterations of the structure herein disclosed will suggest themselves of those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. The combination of a hot water heater and a humidifier for adding moisture to the air in a building having a humidistat, said combination comprising a water tank supported in said building, said tank having a water inlet and an outlet for hot water, heating means for heating the water within the tank to a predetermined temperature and a pressure above ambient pressure and for maintaining the water in the tank substantially at said temperature, means for maintaining the pressure of the water in the tank above ambient pressure, a plenum chamber disposed within said tank, means for supplying a measured quantity of water from said tank to said plenum chamber, an outlet conduit communicating said plenum chamber with ambient air in said building, and means controlled by said humidistat for adding energy to the water in the plenum chamber to agitate and remove water from said plenum chamber through said outlet conduit.

2. The combination as recited in claim 1, wherein said means for adding energy to the water in the plenum chamber comprises heating means for heating the water in the plenum chamber to the point of vaporization.

3. The combination as recited in claim 2, wherein said means for supplying a measured quantity of water to said plenum chamber comprises a valve responsive to the quantity of water in said plenum chamber.

4. The combination as recited in claim 3, wherein said valve comprises a float valve for supplying water to said plenum chamber when the level of water drops within said plenum chamber due to vaporization of quantities thereof.

5. The combination as recited in claim 1, wherein said means for adding energy to the water in the plenum chamber comprises a source of pressurized air, and means for directing pressurized air from said source to said plenum chamber for aerating the water in said plenum and wetting said air thereby.

6. The combination as recited in claim 5, wherein said means for supplying a measured quantity of water to said plenum chamber comprises a valve responsive to the quantity of water in said plenum chamber.

7. The combination as recited in claim 6, wherein said valve comprises a float valve for supplying water to said plenum chamber when the level of water drops within said plenum chamber due to vaporization of quantities thereof.

8. A humidifier for adding moisture to the air in a building having a humidistat, said humidifier comprising a tank supported in said building, said tank having a water inlet and a water outlet, heating means for heating the water within the tank to a predetermined temperature and a pressure above ambient pressure and for maintaining the water in the tank substantially at said temperature, means for maintaining the pressure of the water in the tank above ambient pressure, a plenum chamber disposed within said tank, means for supplying a measured quantity of water from said tank to said plenum chamber, an outlet conduit communicating said plenum chamber with ambient air in said building, and means controlled by said humidistat for adding energy to the water in the plenum chamber to agitate and remove water from said plenum chamber through said outlet conduit.

9. The humidifier as recited in claim 8, wherein said means for adding energy to the water in the plenum chamber comprises heating means for heating the water in the plenum chamber to the point of vaporization.

10. The humidifier as recited in claim 9, wherein said means for supplying a measured quantity of water to said plenum chamber comprises a valve responsive to the quantity of water in said plenum chamber.

11. The humidifier as recited in claim 10, wherein said valve comprises a float valve for supplying water to said plenum chamber when the level of water drops within said plenum chamber due to vaporization of quantities thereof.

12. The humidifier as recited in claim 8, wherein said means for adding energy to the water in the plenum chamber comprises a source of pressurized air, and means for directing pressurized air from said source to said plenum chamber for aerating the water in said plenum and wetting said air thereby.

13. The humidifier as recited in claim 12, wherein said means for supplying a measured quantity of water to said plenum chamber comprises a valve responsive to the quantity of water in said plenum chamber.

14. The humidifier as recited in claim 13, wherein said valve comprises a float valve for supplying water to said plenum chamber when the level of water drops within said plenum chamber due to vaporization of quantities thereof.

* * * * *